US007626564B2

(12) United States Patent
Park et al.

(10) Patent No.: US 7,626,564 B2
(45) Date of Patent: Dec. 1, 2009

(54) APPARATUS FOR DRIVING ELECTROLUMINESCENCE DISPLAY PANEL CAPABLE OF ENERGY RECOVERY

(75) Inventors: Jung-Kook Park, Suwon-si (KR); Il-Han Lee, Suwon-si (KR); Seung-Kyun Hong, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 556 days.

(21) Appl. No.: 11/246,122

(22) Filed: Oct. 11, 2005

(65) Prior Publication Data

US 2006/0103607 A1 May 18, 2006

(30) Foreign Application Priority Data

Oct. 12, 2004 (KR) ..... 10-2004-0081408

(51) Int. Cl.
*G09G 3/30* (2006.01)

(52) U.S. Cl. ..... 345/76

(58) Field of Classification Search ..... 345/76–81
See application file for complete search history.

(56) References Cited

U.S. PATENT DOCUMENTS 6,236,443 B1 5/2001 Carlsen
6,657,681 B1 * 12/2003 Kawamura et al. ..... 349/34
2002/0063668 A1 5/2002 Yoon
2002/0175884 A1 * 11/2002 Kim et al. ..... 345/76

FOREIGN PATENT DOCUMENTS

| | | |
|---|---|---|
| CN | 1462993 | 12/2003 |
| JP | 11281961 | 10/1999 |
| JP | 2000-293131 | 10/2000 |
| JP | 2004-163912 | 6/2004 |

OTHER PUBLICATIONS

Chinese Office Action dated Feb. 15, 2008.

* cited by examiner

*Primary Examiner*—Amr Awad
*Assistant Examiner*—Randal Willis
(74) *Attorney, Agent, or Firm*—H.C. Park & Associates, PLC

(57) ABSTRACT

An apparatus for driving an electroluminescence display panel having an icon area where predetermined icons are displayed according to input icon data and a dot-matrix area where variable images are displayed according to input dot-matrix data. A current that is discharged after the dot-matrix area is driven in each horizontal drive period is applied to at least one of driver power supply terminals of the icon area and the dot-matrix area.

3 Claims, 6 Drawing Sheets

APPARATUS FOR DRIVING ELECTROLUMINESCENCE DISPLAY PANEL CAPABLE OF ENERGY RECOVERY

CROSS REFERENCE TO RELATED APPLICATION

This application claims priority to and the benefit of Korean Patent Application No. 10-2004-0081408, filed on 12 Oct. 2004, which is hereby incorporated by reference for all purposes as if fully set forth herein.

BACKGROUND OF THE INVENTION

1. Field of the Invention

The present invention relates to an apparatus for driving an electroluminescence display panel, and more particularly, to an apparatus for driving an electroluminescence display panel having an icon area where predetermined icons are displayed according to input icon data and a dot-matrix area where variable images are displayed according to input dot-matrix data.

2. Description of the Related Art

An electroluminescence display panel has an icon area where predetermined icons are displayed according to input icon data and a dot-matrix area where variable images are displayed according to input dot-matrix data. The structure of such an electroluminescence display panel is illustrated in patent document, U.S. Pat. No. 6,236,443, incorporated herein by reference, and a detailed description thereof is omitted. In a typical apparatus for driving such an electroluminescence display panel, all data electrode lines are grounded by switching operations for initialization in a next horizontal cycle after the dot-matrix area is driven in a corresponding horizontal cycle. Such switching operations result in there being an increased power consumption.

SUMMARY OF THE INVENTION

The present invention provides an apparatus for driving an electroluminescence panel having an icon area and a dot-matrix area, such that drive power efficiency is maximized and power consumption is reduced in an application device.

Additional features of the invention will be set forth in the description which follows, and in part will be apparent from the description, or may be learned by practice of the invention.

The present invention discloses an apparatus for driving an electroluminescence display panel, including an icon area where an icon is displayed according to input icon data, and a dot-matrix area where a variable image is displayed according to input dot-matrix data, wherein a current that is discharged after the dot-matrix area is driven in a horizontal drive period is applied a driver power supply terminal for the icon area and/or the dot-matrix area.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated herein and constitute a part of this specification, illustrate embodiments of the invention and together with the description serve to explain the principles of the invention.

DESCRIPTION OF THE ILLUSTRATED EMBODIMENTS

Figure 1:
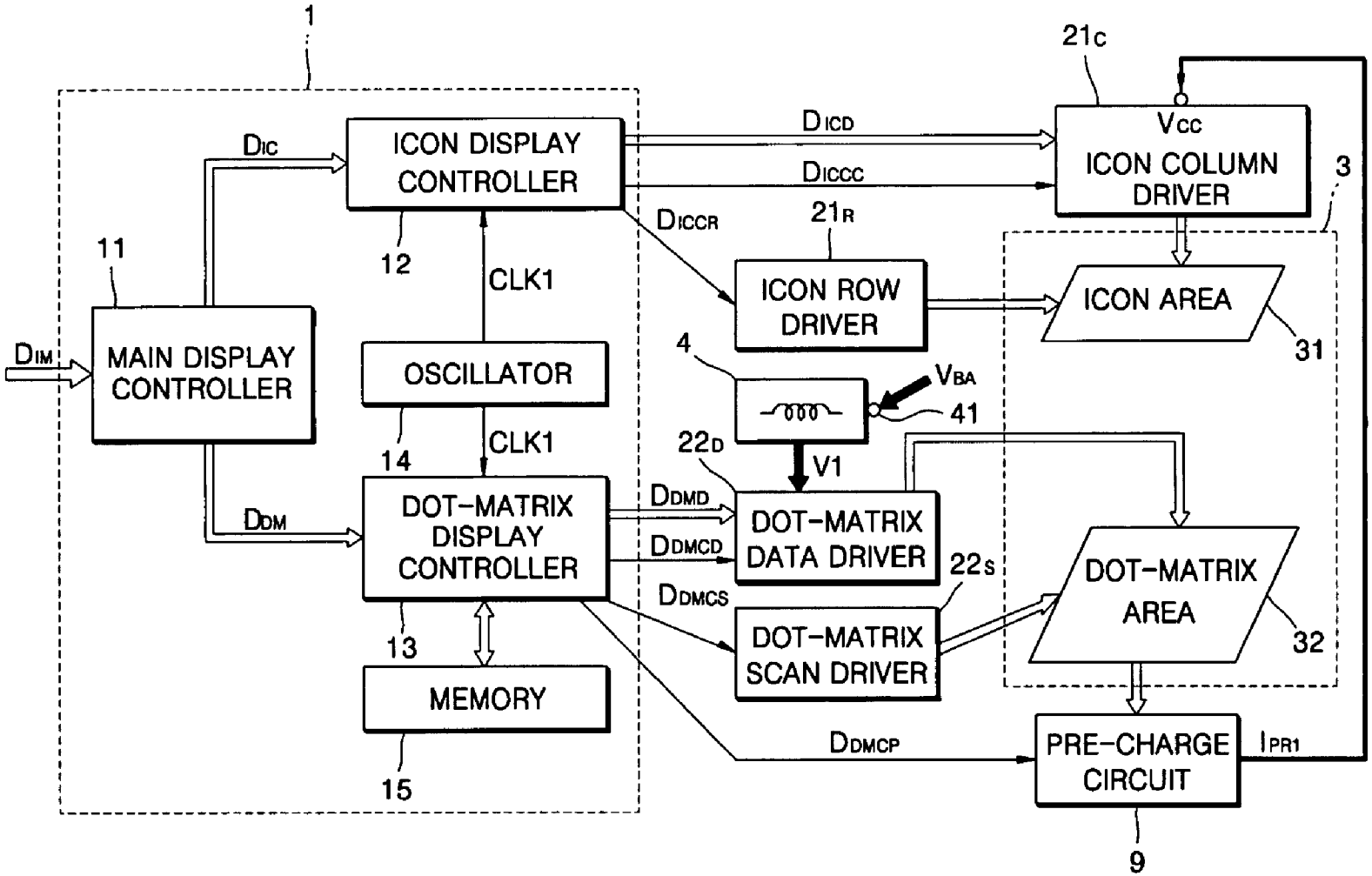
FIG. 1 is a block diagram showing an apparatus for driving an electroluminescence display panel according to an embodiment of the invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity.

Figure 2:
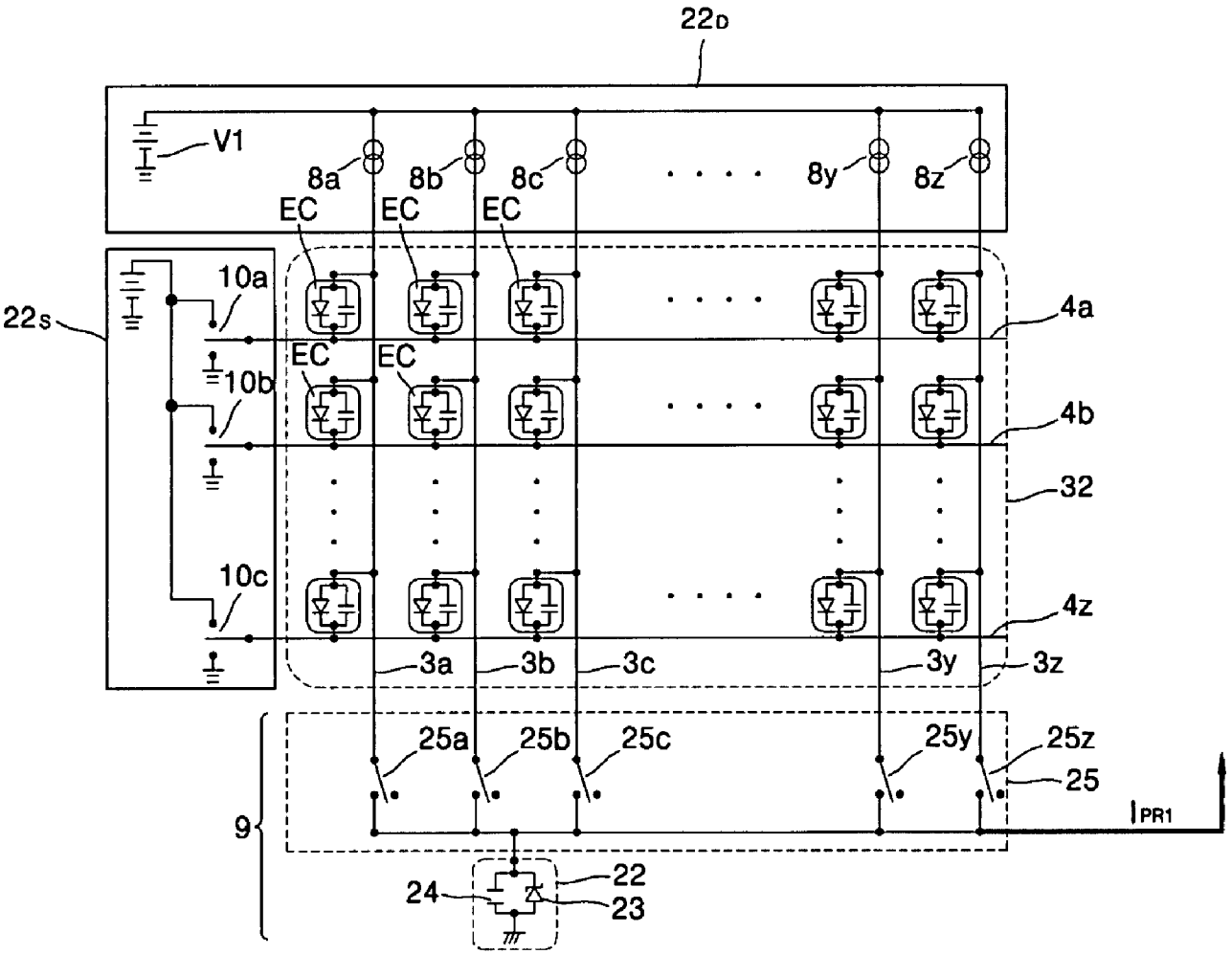
FIG. 2 is a schematic circuit diagram showing a dot-matrix area, a dot-matrix data driver, a dot-matrix scan driver, and a pre-charge unit.

FIG. 1 is a schematic block diagram showing an apparatus for driving an electroluminescence display panel 3 according to an embodiment of the invention. FIG. 2 is a circuit diagram showing a dot-matrix area 32, a dot-matrix data driver 22D, a dot-matrix scan driver 22S, and a pre-charge unit 9. In FIG. 2, a reference symbol, EC, refers to an electroluminescent cell.

An apparatus for driving an electroluminescence display panel 3 includes a controller 1, an icon column driver $\mathbf{21}_C$, an icon row driver $\mathbf{21}_R$, a DC-to-DC converter 4, a dot-matrix data driver $\mathbf{22}_D$, a dot-matrix scan driver $\mathbf{22}_S$, and a pre-charge unit 9.

The electroluminescence display panel 3 includes an icon area 31 and a dot-matrix area 32. In the icon area 31, at least one icon, e.g., a predetermined icon, is displayed according to input icon data. In the dot-matrix area 32, a variable image is displayed according to input dot-matrix data. More specifically, as described in patent document, U.S. Pat. No. 6,236,443, incorporated herein by reference, a plurality of display cells having different shapes may be provided in the icon area 31 in order to display a predetermined icon shape. Display cells having substantially identical shapes are regularly or uniformly established in the dot-matrix area 32 in order to display variable images.

The display controller 1 includes a main display controller 11, an icon display controller 12, a dot-matrix display controller 13, an oscillator 14, and a memory device 15. The display controller 1 may be operated using a control DC voltage, which may be generated by slightly modifying a battery voltage $V_{BA}$, as an input DC voltage.

The display controller 11 outputs input image data $D_{IM}$ separated into icon data $D_{IC}$ and dot-matrix data $D_{DM}$.

The icon display controller 12 processes the icon data $D_{IC}$ from the main display controller 11 based on the internal arrangement on the icon area 31 of the electroluminescence display panel 3 and outputs icon image data $D_{ICD}$, and an icon column control signal $D_{ICCC}$ to the icon column driver $\mathbf{21}_C$, and an icon row-control signal $D_{ICCR}$ to the icon row driver $\mathbf{21}_R$.

The dot-matrix display controller 13 processes the dot-matrix data $D_{DM}$ from the main display controller 11 based on the internal arrangement on the dot-matrix area 32 of the electroluminescence display panel 3 and outputs dot-matrix image data $D_{DMD}$ and a dot-matrix data-control signal $D_{DMCD}$ to the dot matrix data driver $\mathbf{21}_D$, a dot-matrix scan-control signal $D_{DMCS}$ to the dot matrix scan driver $\mathbf{22}_S$, and a pre-charge control signal $D_{DMCP}$ to the dot pre-charge circuit 9. The dot-matrix display controller 13 may control the dot-matrix image data $D_{DND}$ so that it is temporarily stored in the memory device 15. The oscillator 14 generates a clock signal CLK1 consisting of a predetermined frequency of pulses, and transmits the clock signal CLK1 to the icon display controller 12 and the dot-matrix display controller 13.

The icon column driver $\mathbf{21}_C$ drives the column electrode lines of the icon area 31 based on the icon column-control signal $D_{ICCC}$ and the icon image data $D_{ICD}$ received from the icon display controller 12. The icon row driver $\mathbf{21}_R$ drives row electrode lines of the icon area 31 based on the icon row-control signal $D_{ICCR}$ received from the icon display controller 12.

The DC-to-DC converter 4 increases the input DC voltage $V_{BA}$ applied to the input voltage terminal 41 to supply the increased voltage V1 to the dot-matrix data driver $\mathbf{22}_D$.

The dot-matrix data driver $\mathbf{22}_D$ drives the data electrode lines 3*a* through 3*z* in the dot-matrix area 32 based on the dot-matrix data-control signal $D_{DMCD}$ and the dot-matrix image data $D_{DMD}$ received from the dot-matrix display controller 13. Specifically, the increased voltage V1 from the DC-to-DC converter 4 drives current sources 8*a* through 8*z* based on their own gradation data, respectively.

The dot-matrix scan driver $\mathbf{22}_S$ controls scan switches 10*a* through 10*c* based on the dot-matrix scan-control signal $D_{DMCS}$ from the dot-matrix display controller 13 to drive the scan electrode lines 4*a* through 4*z* of the dot-matrix area.

As shown in FIG. 2, the pre-charge unit 9 may include a switching circuit 25 and a charging circuit 22. The switching circuit 25 includes a plurality of switching elements 25*a* through 25*z* connected, e.g., coupled, with the data electrode lines 3*a* through 3*z* in the dot-matrix area 32, respectively. The charging circuit 22 is connected, e.g., coupled, between a common output terminal of the switching circuit 25 and a ground terminal to reserve part of the current discharged after the dot-matrix area 32 is driven.

Thus, for example, the common output terminal of the switching circuit 25 is electrically connected, e.g., coupled, with the power terminal $V_{CC}$ of the icon column driver $\mathbf{21}_C$. Therefore, the current $I_{PR1}$ that is discharged after the dot-matrix area 32 is driven in each horizontal drive cycle is applied to the driver power supply terminal $V_{CC}$ of the icon area 31. This will maximize drive power efficiency and reduce power consumption in an application device as compared with conventional driving apparatus.

Figure 3:
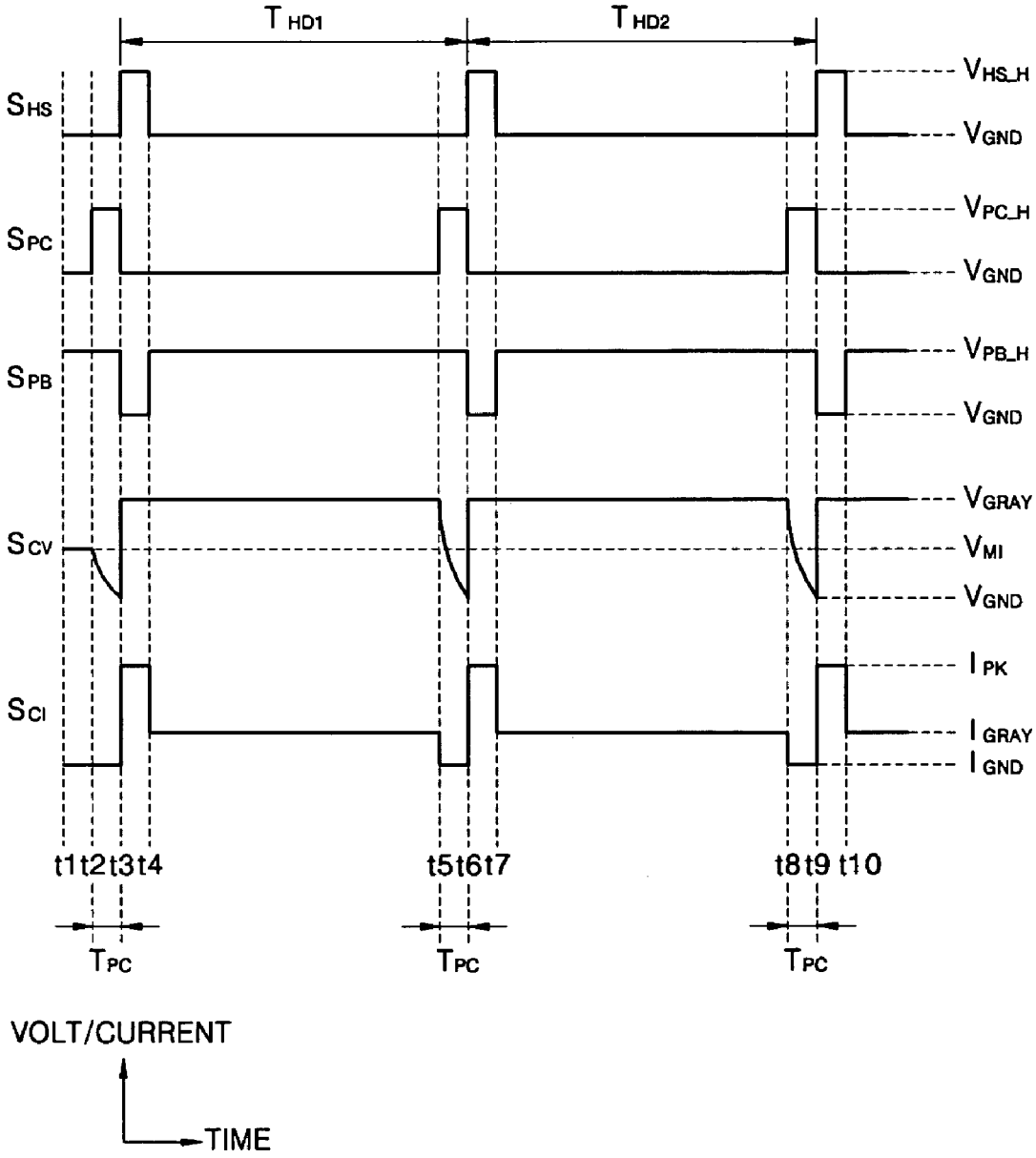
FIG. 3 is a timing chart showing control and drive signals for driving a dot-matrix area shown in FIG. 1.

FIG. 3 is a timing chart showing control and drive signals for driving the dot-matrix area 32 shown in FIG. 1. In FIG. 3, $S_{HS}$ is a horizontal synchronization signal included in the dot-matrix data $D_{DM}$. $S_{PC}$ is a pre-charge signal included in the dot-matrix data-control signal $D_{DMCD}$ and the pre-charge control signal $D_{DMCP}$. $S_{PB}$ is a peak-booting signal included in the dot-matrix data-control signal $D_{DMCD}$ and the pre-charge control signal $D_{DMCP}$. $S_{CV}$ is a voltage on one of the data electrode lines 3*a* through 3*z*. $S_{C1}$ is the amount of current on one of the data electrode lines 3*a* through 3*z*.

Referring to FIG. 2 and FIG. 3, each horizontal drive cycle $T_{HD1}$, $T_{HD2}$ starts when the voltage of the horizontal synchronization signal $S_{HS}$ is triggered from a ground voltage $V_{GND}$ to a high voltage $V_{HS_H}$. In the first horizontal drive cycle $T_{HD1}$, a peak-booting current $I_{PK}$ having a maximum current amount is applied to the data electrode lines 3*a* through 3*z* during an interval t3 through t4. The peak-booting signal $S_{PB}$ decreases from a high voltage $V_{PC_H}$ to a ground voltage $V_{GND}$ in order to charge parasitic capacitors in the electroluminescent cells. This minimizes an influence of the parasitic capacitor during an actual operation interval t4 through t5, at which a drive current $I_{GRAY}$ that is proportional to the gradation data flows from the data electrode lines 3*a* through 3*z* to each electroluminescent cell EC.

As a result, during a pre-charge timing $T_{PC}$, the switching elements 25*a* through 25*z* in the switching circuit 25 are turned on, so that a part of the current $I_{PR1}$ to be discharged after the actual operating time of t4 through t5 is discharged through a power supply terminal $V_{CC}$ in the driver of the icon area 31 at an earlier timing. Therefore, it is possible to maximize driving current efficiency and reduce power consumption. Meanwhile, part of the currents to be discharged after the actual operation time of t4 through t5 is charged in the charging circuit 22, which reduces the data drive voltage.

Operations in the second horizontal drive cycle $T_{HD2}$ are similar to those in the first horizontal drive cycle $T_{HD1}$ and discussion thereof is omitted for purposes of convenience.

Figure 4:
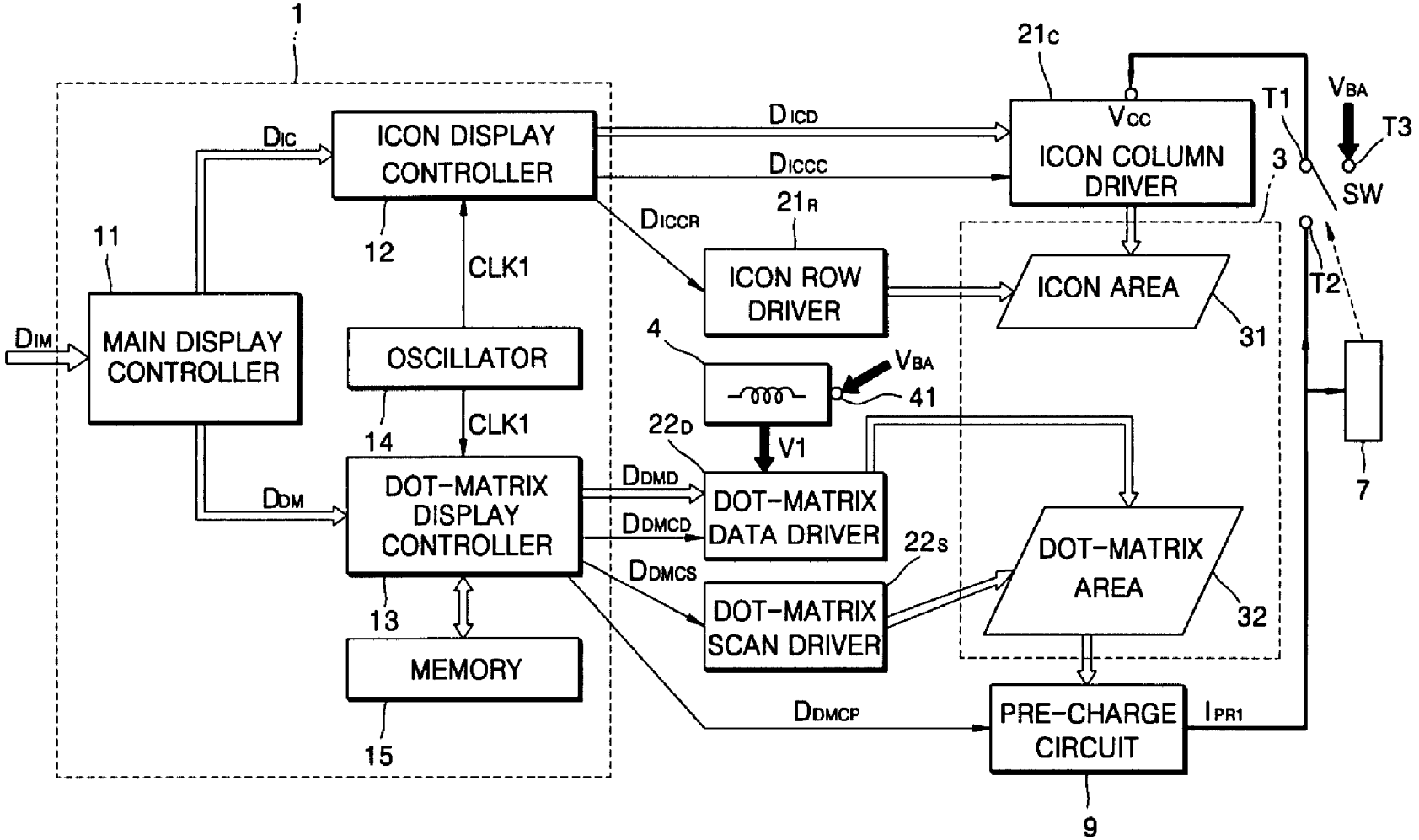
FIG. 4 is a block diagram showing an apparatus for driving an electroluminescence display panel according to another embodiment of the invention.

FIG. 4 is a block diagram illustrating an apparatus for driving an electroluminescence display panel 32 according to another embodiment of the invention. Like reference numerals in FIG. 1 and FIG. 4 denote like elements. Also, driving sequences in FIG. 3 is may be similarly applied to the apparatus shown in FIG. 4, and thus only differences between FIG. 1 and FIG. 4 are described below.

According to the embodiment shown in FIG. 4, a switching element SW may be connected or coupled between the common output terminal of the switching circuit 25 and the power supply terminal $V_{CC}$ of the icon column driver $\mathbf{21}_C$. A switching controller 7 may be included to control operations of the switching element SW depending on the amount of current flowing from the common output terminal of the switching circuit 25. For example, when the amount of the current from the common output terminal of the switching circuit 25 exceeds a predetermined level, the power supply terminal $V_{CC}$ of the icon column driver $\mathbf{21}_C$ is coupled with the common output terminal of the switching circuit 25. Otherwise, the power supply terminal $V_{CC}$ of the icon column driver $\mathbf{21}_C$ is coupled with a separate power supply terminal T3. For example, when only the icon area 31 is turned on in response to a user's selection, the power supply terminal $V_{CC}$ of the icon column driver $\mathbf{21}_C$ is coupled with a separate power supply terminal T3.

Figure 5:
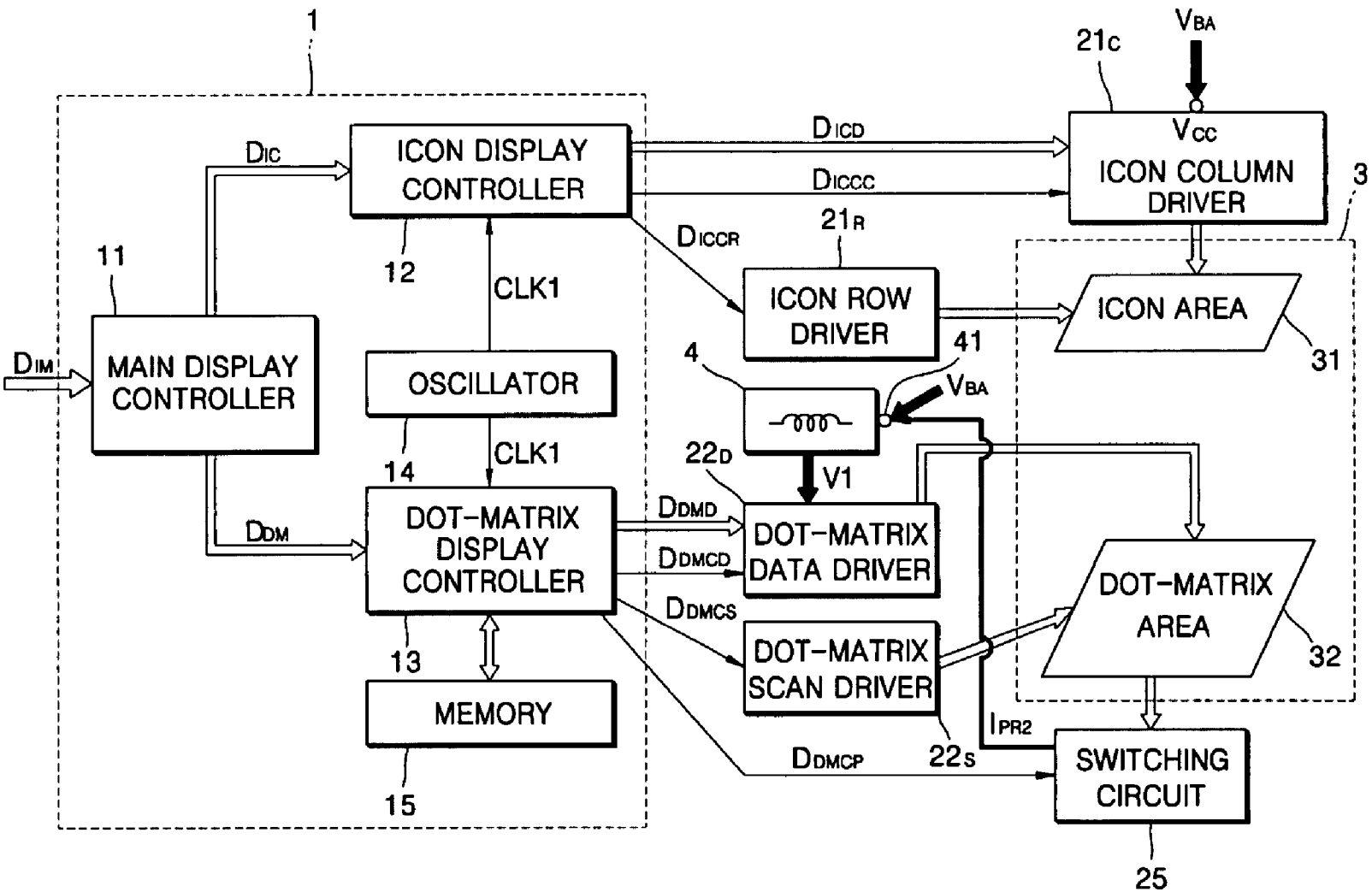
FIG. 5 is a block diagram illustrating an apparatus for driving an electroluminescence display panel according to yet another embodiment of the invention.
Figure 6:
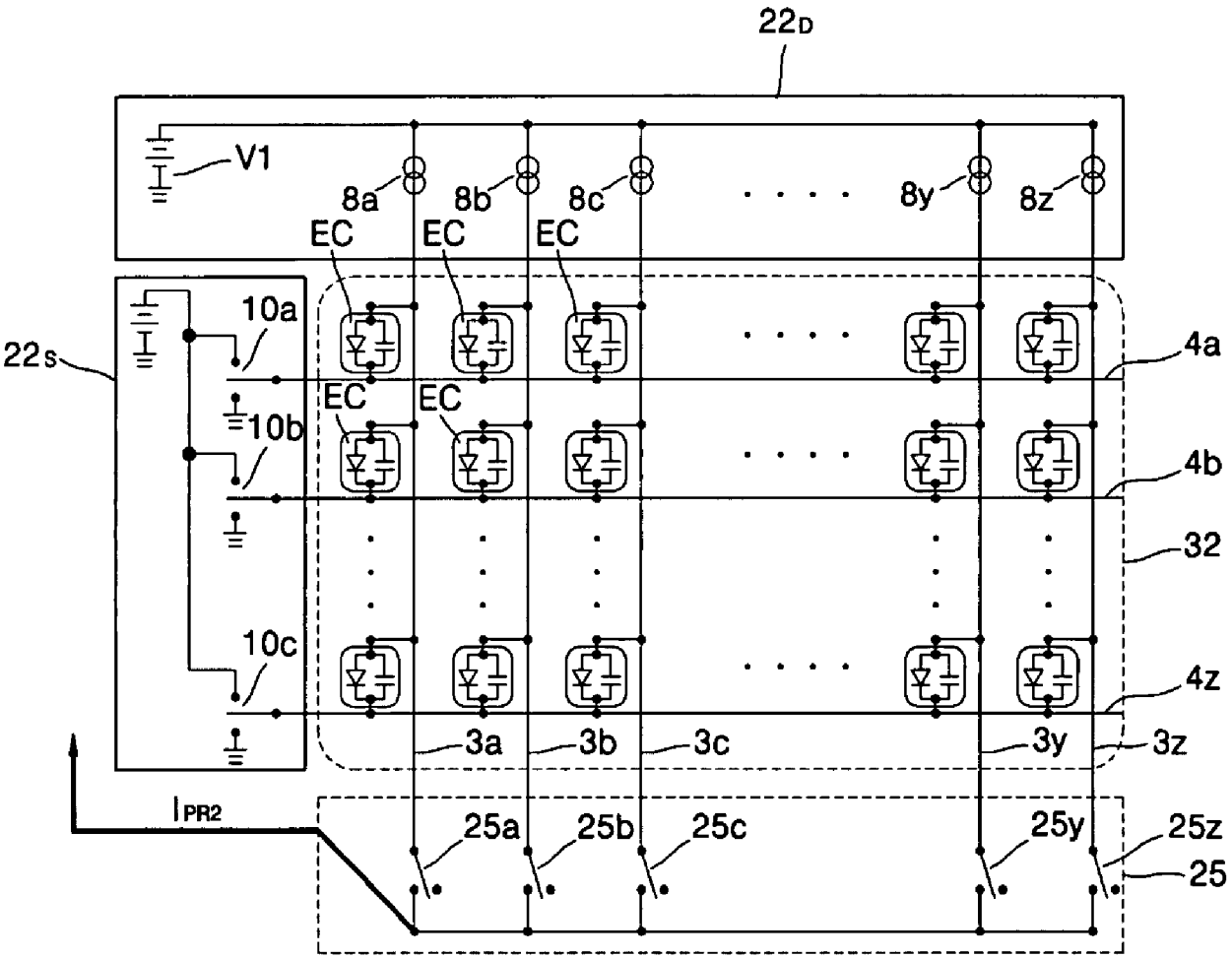
FIG. 6 is a schematic circuit diagram illustrating a dot-matrix area, a dot-matrix data driver, a dot-matrix scan driver, and a switching circuit.

FIG. 5 is a block diagram showing an apparatus for driving an electroluminescence display panel 32 according to yet another embodiment of the invention. FIG. 6 is a circuit diagram illustrating a dot-matrix area 32, a dot-matrix data driver $\mathbf{22}_D$, a dot-matrix scan driver $\mathbf{22}_S$, and a switching circuit 25. In FIG. 5 and FIG. 6, like reference numerals denote like elements. Also, driving sequences in FIG. 3 may be similarly applied to the apparatus shown in FIG. 5, and thus only the substantial differences between FIG. 1 and FIG. 5 are described below.

The common output terminal of the switching circuit 25 is electrically connected to, e.g., coupled, with an input voltage terminal 41 of the DC-to-DC converter 4. As a result, the current $I_{PR2}$ that is discharged after the dot-matrix area 32 is driven in each horizontal drive cycle $T_{HD1}$, $T_{HD2}$ is discharged through the input voltage terminal 41 of the DC-to-DC converter 4. Therefore, the drive current efficiency may be maximized and power consumption may be reduced in an application device.

According to the above described embodiments, the number of times for charging batteries of an electroluminescence display apparatus may be reduced. Therefore, it is possible to give accommodation to users.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An apparatus for driving an electroluminescence display panel, comprising:

an icon area where an icon is displayed according to input icon data;

a dot-matrix area where a variable image is displayed according to input dot-matrix data, the dot-matrix area comprising a data electrode line and a scan electrode line;

a dot-matrix driver to drive the data electrode line of the dot-matrix area;

a dot-matrix scan driver to drive the scan electrode line of the dot-matrix area;

a switching circuit having a switching element coupled with the data electrode line of the dot-matrix area;

an icon column driver to drive a column electrode line of the icon area;

an icon row driver to drive a row electrode line of the icon area;

a switch;

a switching controller;

a power supply terminal of the icon column driver; and a separate power supply terminal, wherein a current that is discharged after the dot-matrix area is driven in a horizontal drive period is applied to a driver power supply terminal for the icon area and/or the dot-matrix area, the driver power supply terminal being connected to the data electrode line when the current is applied to the driver power supply terminal, and wherein the switching controller controls the switch to couple either the separate power supply terminal or a common output terminal of the switching circuit to the power supply terminal of the icon column driver.

2. The apparatus of claim 1, wherein the switching controller controls the switch according to an amount of current received from the common output terminal of the switching circuit.

3. The apparatus of claim 2, wherein when the amount of current received from the common output terminal of the switching circuit exceeds a first amount, the switching controller controls the switch to couple the common output terminal of the switching circuit to the power supply terminal of the icon column driver, and when the amount of current received from the common output terminal of the switching circuit is less than the first amount, the switching controller controls the switch to couple the separate power supply terminal to the power supply terminal of the icon column driver.

* * * * *

UNITED STATES PATENT AND TRADEMARK OFFICE

CERTIFICATE OF CORRECTION

PATENT NO. : 7,626,564 B2
APPLICATION NO. : 11/246122
DATED : December 1, 2009
INVENTOR(S) : Park et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 972 days.

Signed and Sealed this

Second Day of November, 2010

David J. Kappos

David J. Kappos
*Director of the United States Patent and Trademark Office*